United States Patent [19]

Kimura

[11] Patent Number: 4,648,487

[45] Date of Patent: Mar. 10, 1987

[54] DRIVE WHEEL EQUIPPED WITH POWER SPRING

[75] Inventor: Shigeo Kimura, Omochano, Japan

[73] Assignee: Kabushiki Kaisha Bandai, Japan

[21] Appl. No.: 745,295

[22] Filed: Jun. 14, 1985

[30] Foreign Application Priority Data

Mar. 14, 1985 [JP] Japan ..... 60-51414

[51] Int. Cl.[4] ..... F03G 1/08; A63H 29/04

[52] U.S. Cl. ..... 185/39; 74/802; 185/DIG. 1; 301/6 D; 446/464

[58] Field of Search ..... 185/37, 39, DIG. 1; 74/802; 446/464; 242/107 R; 301/6 D

[56] References Cited

U.S. PATENT DOCUMENTS 3,817,472 6/1974 Abe ..... 185/39 X
4,463,831 8/1984 Wakase ..... 185/DIG. 1 X
4,478,313 10/1984 Wakase ..... 185/DIG. 1 X

FOREIGN PATENT DOCUMENTS 2166888 7/1976 Fed. Rep. of Germany ..... 185/39
1568700 6/1980 United Kingdom ..... 185/DIG. 1

*Primary Examiner*—Allan D. Herrmann
*Attorney, Agent, or Firm*—R. Gale Rhodes, Jr.

[57] ABSTRACT

A drive wheel has a power spring within a drum housing formed on one side of the casing. The drive wheel includes a sun gear and a fixed pinion rotatably mounted about a shaft of the sun gear, the power spring being coupled between the sun gear and the fixed position of the drum housing. The fixed gear is fixedly connected to the vehicle body and the sun gear is rotatably mounted centrally of the casing. Spring winding and release gear trains are mounted in cooperative association with the sun gear and fixed pinion and provided with respective shift gears movable generally in the radial direction or perpendicular direction to the rotation of the shaft. An idle gear always meshing with the shift gear of the spring winding gear train is provided.

2 Claims, 4 Drawing Figures

DRIVE WHEEL EQUIPPED WITH POWER SPRING

BACKGROUND OF THE INVENTION

1. Field of the Invention

The present invention relates to a drive wheel equipped with a power spring in the drive wheel, and more particularly it relates to the structure of a drive wheel as above in which the number of elements and the number of manufacturing processes are reduced and mechanical loss is minimized.

2. Prior Art

A drive wheel having therein a flat spiral spring for giving power to the drive wheel according to the prior art is shown in FIGS. 3 and 4. In the figures, numeral 1 represents a casing or wheel frame of a drive wheel. The casing 1 comprises inner and outer side frames 1-1 and 1-2 made of synthetic resin or the like. The inner and outer side frames 1-1 and 1-2 are coupled to form a cylindrical hollow casing 1. The outer side frame 1-2 is formed with a drum housing 3 for accommodating a power spring 2. The inner side frame 1-1, which is mounted covering the outer side frame 1-2, is formed with a raised rim 4. A tire 5 made of rubber or the like is coupled about the casing 1 by means of the raised rim 4. Numeral 6 represents a partition wall fixedly mounted on one side of the drum housing 3. Recesses for bearing the shafts of gears housed within the casing 1 are formed in the partition wall 6 and the inner side frame 1-1.

A central or sun gear 25 is fixedly connected to a shaft 26 which is rotatably mounted centrally of the casing 1. The sun gear 25 is formed with an engaging section 24 to which one end of the power spring 2 in the drum housing 3 is fixed, the other end of the power spring 3 being fixed to the inner periphery of the drum housing 3. A fixed pinion 28 is fixedly connected to a chassis 1-3 of a vehicle (not shown) by means of an indentation section 27 formed on the surface of the fixed pinion 28. The shaft 26 of the sun gear 25 is rotatably inserted in the fixed pinion 28.

In cooperative association with the central gear 25 and the fixed pinion 28, there are provided with a spring winding gear train and a spring release gear train. The spring winding gear train comprises a shift gear 30 with its shaft 30' and a planetary gear 29 with its shaft 29', the shift gear 30 being movable generally concentrically of the rotation of the shaft 26 along an elongated slit 30-1. The spring release gear train comprises a shift gear 31 with its shaft 31', a spur gear 32 integrally coupled to the shift gear 31, and a planetary gear 33 with its shaft 33', the shift gear 31 being movable generally concentrically of the shaft 26 along an elongated slit 31-1. Both shift gears 30 and 31 are respectively provided with restoration springs 34 and 35.

With the drive wheel constructed as above, by pulling back a toy vehicle to which the drive wheel is mounted with the fixed pinion 28 connected to the chassis 1-3 via the indentation section 27, the casing 1 is rotated clockwise due to the friction between the tire 5 and the ground or floor. Upon rotating of the casing 1, the power spring 2 is wound up through the planetary gear 29 and the shift gear 30 of the spring winding gear train. On the other hand, after the power spring 2 is wound up, if the hand is released from the vehicle, then the sun gear 25 is rotated counter clockwise due to the release of the wound power spring 2. Thus, the toy vehicle runs forward by the power transmitted from the power spring 2, the planetary gear 33, the shift gear 31, and the spur gear 32 of the spring release gear train, and the fixed pinion 28.

In winding the power spring through the spring winding gear train, the shift gear 31 of the spring release gear train is returned to a restoration position by the spring 35. On the other hand, in driving the toy vehicle through the spring release gear train, the shift gear 30 of the spring winding gear train is returned to a restoration position by the spring 34. Therefore, in winding the power spring or driving the vehicle, both gear trains operate without interfering the operation of the other gear train.

The above mechanism however is associated with some problems. In particular, although the influences of centrifugal force during the rotation of the casing 1 are avoided because of the concentrical movement of the shift gears 30 and 31 relative to the rotation of the shaft 26, it is necessary to provide the respective restoration springs 34 and 35. Power transmission is carried out against the restoration springs 34 and 35 for the respective shift gears 30 and 31. Thus, fine adjustment of the spring force is difficult to obtain and mechanical loss in power transmission occurs due to the force acting against the spring force. Particularly, the larger the number of elements constituting the power transmission mechanism becomes, the more the proper mounting of the springs 34 and 35 becomes difficult. Furthermore, the number of assembling processes becomes large, thereby resulting in high manufacturing cost.

SUMMARY OF THE INVENTION

It is therefore an object of the present invention to provide a drive wheel equipped with a power spring which can eliminate the above prior art problems.

It is another object of the present invention to provide a drive wheel equipped with a power spring which can reduce the numbers of elements and assembly processes and is subjected to a low mechanical loss.

According to one aspect of the present invention, a drive wheel provided with a power spring for a vehicle comprises: a casing of a cylindrical hollow shape serving as a wheel frame, said casing being formed on one side with a drum housing for accommodating said power spring; a sun gear rotatably mounted centrally of said casing, said sun gear being formed with a first engaging section to which one end of said power spring is fixed while the other end of said power spring is fixed at the inner periphery of said drum housing; a fixed pinion in which the shaft of said sun gear being rotatably inserted, said fixed pinion being formed with a second engaging section to which said vehicle is fixedly connected; a spring winding gear train in cooperative association with said sun gear and fixed pinion, said spring winding gear train being provided with a first shift gear movable generally in the radial direction or perpendicular direction to the rotation of said shaft; and a spring release gear train in cooperative association with said sun gear and fixed pinion, said spring release gear train being provided with a second shift gear movable generally in the radial direction or perpendicular direction to the rotation of said shaft.

The foregoing and other objects are effected by the invention as will be apparent from the following description and claims taken in connection with the accompanying drawings, forming a part of this application, in which:

Figure 1:
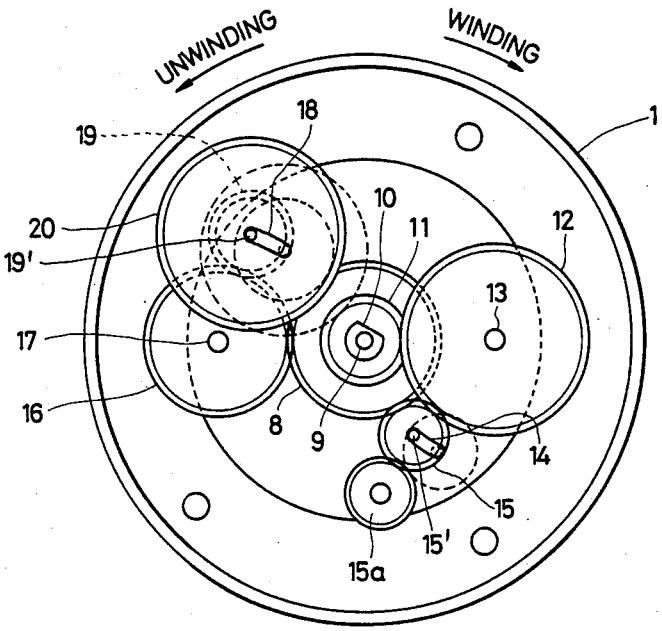
FIG. 1 is a plan view showing the main portion of an embodiment of the drive wheel equipped with a power spring according to the present invention.
Figure 2:
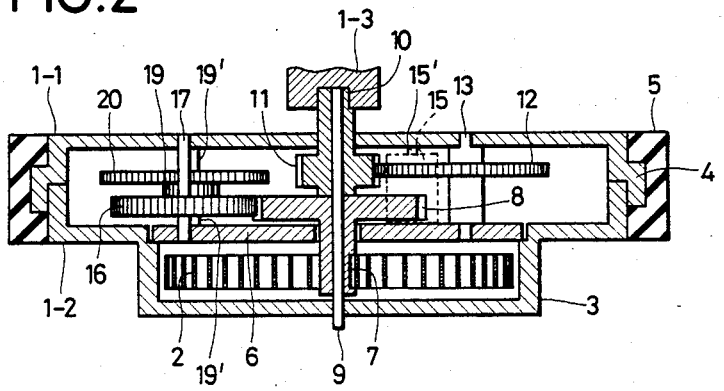
FIG. 2 is a cross sectional side view showing the main portion of the embodiment of the drive wheel.
Figure 3:
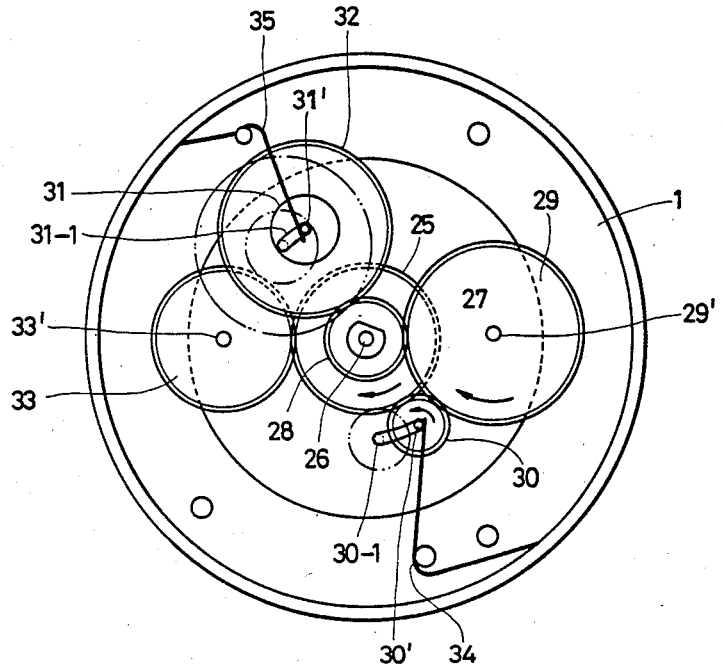
FIG. 3 PRIOR ART
FIG. 3 is a plan view showing the main portion of a prior art drive wheel equipped with a power spring.
Figure 4:
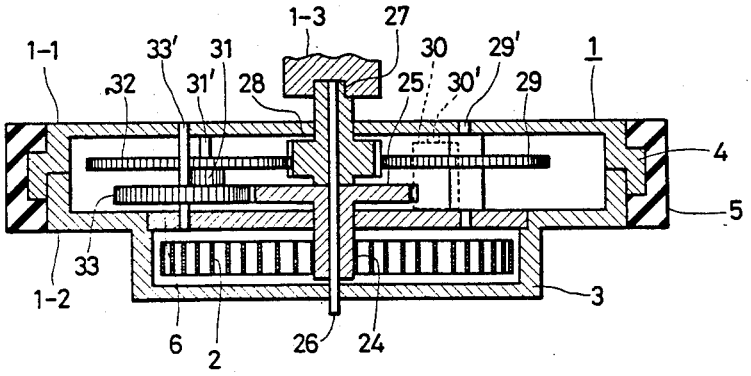
FIG. 4 PRIOR ART
FIG. 4 is a cross sectional side view showing the main portion of the drive wheel of FIG. 3. DETAILED DESCRIPTION OF THE PREFERRED EMBODIMENT Referring now to FIGS. 1 and 2, the present invention will be described with reference to a preferred embodiment of the drive wheel.

The drive wheel has therein a flat spiral spring for giving power to the drive wheel. In the figures, numeral 1 represents a casing or wheel frame of the drive wheel. The casing 1 comprises inner and outer side frames 1-1 and 1-2 made of synthetic resin or the like. The inner and outer side frames 1-1 and 1-2 are coupled to form a cylindrical hollow casing 1. The outer side frame 1-2 is formed with a drum housing 3 for accommodating a power spring 2. The inner side frame 1-1, which is mounted covering the outer side frame 1-2, is formed with a raised rim 4. A tire 5 made of rubber or the like is coupled about the casing 1 by means of the raised rim 4. Numeral 6 represents a partition wall fixedly mounted on one side of the drum housing 3. Recesses for bearing the shafts of gears housed within the casing 1 are formed in the partition wall 6 and the inner side frame 1-1.

A central or sun gear 8 is fixedly connected to a shaft 9 which is rotatably mounted centrally of the casing 1. The sun gear 8 is formed with an engaging section 7 to which one end of the power spring 2 in the drum housing 3 is fixed, the other end of the power spring 2 being fixed to the inner periphery of the drum housing 3. A fixed pinion 11 is fixedly connected to a chassis 1-3 of a vehicle (not shown) by means of an indentation section 10 formed on the surface of the fixed pinion. The shaft 9 of the sun gear 8 is rotatably inserted into the fixed pinion 11.

In cooperative association with the central gear 8 and the fixed pinion 11, there are provided with a spring winding gear train provided with a shift gear movable generally in the radial direction of the shaft 9 and a spring release gear train provided similarly with another shift gear movable generally in the radial direction of the shaft 9. More in particular, the spring winding gear train comprises a planetary gear 12 meshing with the fixed pinion 11, and a shift gear 15 with its shaft 15'. The shift gear 15 is rotatably and movably mounted on an elongated bearing hole 14 of an arcuate shape, concentrically of the shaft 13 of the planetary gear 12. The shift gear 15 always meshes with the planetary gear 12 and removably meshes with the sun gear 8. On the other hand, the spring release gear train comprises a planetary gear 16 meshing with the sun gear 8, and a shift gear 19 with its shaft 19'. The shift gear 19 is rotatably and movably mounted on an elongated bearing hole 18 of an arcuate shape, concentrically of the shaft 17 of the planetary gear 16. The shift gear 19 is integrally formed with a spur gear 20 which is removably meshes with the fixed pinion 11. The shift gear 15 of the spring winding gear train is provided with an idle gear 15*a* always meshing with the shift gear 15.

The drive wheel constructed as above may be used as drive wheels for a toy vehicle. By pulling back a toy vehicle to which the drive wheel is mounted with the fixed pinion 11 connected to the chassis 1-3 via the indentation section 10, the casing 1 is rotated clockwise due to the friction between the tire 5 and the ground or floor. Upon rotating of the casing 1, the power spring 2 is wound up by the clockwise rotation of the sun gear 8 which driven through the planetary gear 12 and the shift gear 15 of the spring winding gear train. In this case, the planetary gear 16 rotates counter clockwise and its torque causes the shift gear 19 to move outward relative to the sun gear 8, thereby releasing the spring release gear train. On the other hand, after the power spring 2 is wound up, if the hand is released from the vehicle, then the sun gear 8 is rotated counter clockwise due to the release of the wound power spring 2. Thus, the toy vehicle runs forward by the power transmitted from the power spring 2, the planetary gear 16, the shift gear 19, and the spur gear 20 of the spring release gear train, and the fixed pinion 11. In this case, the planetary gear 12 rotates counter clockwise and its torque causes the shift gear 15 to move outward relative to the sun gear 8, thus releasing the spring winding gear train. During the movement of the shift gear 15 of the spring winding gear train, the shift gear 15 is ensured its correct movement by receiving force from the idle gear 15*a* due to its counter action during rotation.

As described above, in winding the power spring 2 through the spring winding gear train, although the direction of movement of the shift gear 15 is substantially perpendicular or radial to the rotation of the shaft 9, that is, the direction being liable to receive centrifugal force of the rotation, the shift gear 15 can be reliably moved with the help of the idle gear 15*a*. More in precise, for example, the shift gear 15 can move without making its own shaft slanted. In this case, the rotation of the idle gear 15*a* causes no substantial mechanical loss. Thus, the operation during the gear winding or release is properly performed. Furthermore, the number of elements and assembly processes are reduced and the manufacturing cost is reduced.

What is claimed is:

1. A drive wheel provided with a power spring for a vehicle comprising:

a casing of a cylindrical hollow shape serving as a wheel frame, said casing being formed on one side with a drum housing for accommodating said power spring;

a sun gear rotatably mounted centrally of said casing, said sun gear being formed with a first engaging section to which one end of said power spring is fixed while the other end of said power spring is fixed at the inner periphery of said drum housing;

a fixed pinion in which a shaft of said sun gear is rotatably inserted, said fixed pinion being formed with a second engaging section to which said vehicle is fixedly connected;

a spring winding gear train in cooperative association with said sun gear and fixed pinion, said spring winding gear train being provided with a first shift gear movable generally in the radial direction or perpendicular direction to the rotation of said shaft; and a spring release gear train in cooperative association with said sun gear and fixed pinion, said spring release gear train being provided with a second shift gear movable generally in the radial direction or perpendicular direction to the rotation of said shaft.

2. A drive wheel according to claim 1 further comprising an idle gear always meshing with said first shift gear of said spring winding gear train.

* * * * *